US009549595B1

(12) United States Patent
Liu

(10) Patent No.: US 9,549,595 B1
(45) Date of Patent: Jan. 24, 2017

(54) INVERSELY FOLDABLE AUTOMATIC UMBRELLA

(71) Applicant: Hao-Ming Liu, Taichung (TW)

(72) Inventor: Hao-Ming Liu, Taichung (TW)

( * ) Notice: Subject to any disclaimer, the term of this patent is extended or adjusted under 35 U.S.C. 154(b) by 0 days.

(21) Appl. No.: 14/951,200

(22) Filed: Nov. 24, 2015

(51) Int. Cl.
*A45B 19/00* (2006.01)

(52) U.S. Cl.
CPC ..... *A45B 19/00* (2013.01); *A45B 2019/008* (2013.01)

(58) Field of Classification Search
CPC .... A45B 2019/008; A45B 19/10; A45B 19/00
USPC ..... 135/27, 31, 25.33
See application file for complete search history.

(56) References Cited

U.S. PATENT DOCUMENTS 386,260 A * 7/1888 Pearce ..... A45B 19/10 135/25.31
1,843,961 A * 2/1932 Stone ..... A45B 19/10 135/25.32
2,788,792 A * 4/1957 Koller ..... A45B 25/22 135/15.1
4,978,110 A * 12/1990 Lin ..... A45B 3/04 135/33.4
2004/0211451 A1* 10/2004 Goh ..... A45B 25/20 135/31
2006/0185701 A1* 8/2006 Chen ..... A45B 25/02 135/31

FOREIGN PATENT DOCUMENTS

DE 2510473 A1 * 9/1976 ..... A45B 19/10
GB 1418814 A * 12/1975 ..... A45B 19/10
TW 212015000007 U1 * 11/2015 ..... A45B 19/00

* cited by examiner

*Primary Examiner* — Noah Chandler Hawk
(74) *Attorney, Agent, or Firm* — WPAT, P.C., Intellectual Property Attorneys; Anthony King

(57) ABSTRACT

An inversely foldable automatic umbrella includes a main shaft; an operating sleeve and a connecting sleeve mounted around the main shaft; a compression spring with two ends thereof contacting the connecting sleeve and the operating sleeve, respectively; a first canopy with a central portion thereof fixed to the operating sleeve; a second canopy with a central portion thereof fixed to the top end; a skeleton disposed between the first canopy and the second canopy; and a pull-moving mechanism having a sliding unit and a connecting unit. The sliding unit is slidingly disposed on the skeleton. Two ends of the connecting unit are pivotally disposed on the sliding unit and the operating sleeve, respectively. When the operating sleeve is at a folding position to fold up the first canopy and the second canopy, the skeleton is allowed to completely adhere to the main shaft.

8 Claims, 7 Drawing Sheets

INVERSELY FOLDABLE AUTOMATIC UMBRELLA

BACKGROUND OF THE INVENTION

1. Field of the Invention

The present invention relates to umbrellas, and more particularly, to an inversely foldable automatic umbrella.

2. Description of the Related Art

Regarding the present arts, a known inversely foldable umbrella comprises a main shaft, an operating sleeve, a first canopy, a second canopy, and a skeleton. When the operating sleeve is at an opening position, plural first foldable rods and second foldable rods are moved, such that the skeleton expands toward the bottom end of the main shaft, whereby the first and second canopies expand. When the operating sleeve is at a folding position, the skeleton is folded toward the top end of the main shaft, such that the first and second canopies are folded upward. As a result, the second canopy which is wet is folded in the first canopy, preventing the raindrop attached to the second canopy from dropping.

Further, for meeting different market demands, manufactures improve the aforementioned inversely foldable umbrella into an inversely foldable automatic umbrella, additionally comprising a connecting sleeve, a compression spring, and plural connecting rods. The connecting sleeve is mounted around the main shaft and disposed between the top end of the main shaft and the operating sleeve. One end of each first foldable rod which is originally pivotally disposed on the operating sleeve is improved to be pivotally disposed on the connecting sleeve. Two ends of the compression spring contacts the connecting sleeve and the operating sleeve, respectively. One end of each connecting rod is pivotally disposed on the operating sleeve, with the other end of the connecting rod pivotally disposed on the skeleton. When the operating sleeve is not fixed at the folding position, the compression spring pushes the connecting sleeve by use of the resilient force, thereby triggering the operating sleeve to slide from the folding position to the opening position, expanding the first and second canopies.

However, regarding the inversely foldable automatic umbrella above, the operating sleeve is connected to each first foldable rod through each corresponding connecting rod, and the junction of each connecting rod pivotally connected to the corresponding first foldable rod is invariable. When the umbrella is being folded, the operating sleeve slides from the opening position to the folding position, the skeleton is folded toward the top end of the main shaft, such that each of the first foldable rods is unable to completely adhere to the main shaft. As a result, the whole volume of the folded umbrella is relatively large; also, the skeleton is easy to be broken during the folding operation.

SUMMARY OF THE INVENTION

For improving the aforementioned issues, an inversely foldable automatic umbrella is disclosed, wherein an operating sleeve is connected with a sliding unit which is slidingly disposed on a skeleton through a connecting unit, such that the skeleton is allowed to completely adhere to the main shaft after being folded up.

For achieving the objectives above, an inversely foldable automatic umbrella is provided, comprising:

a main shaft, having a top end and a bottom end;

an operating sleeve, mounted around the main shaft, moving between a folding position and an opening position, and optionally positioned at the folding position;

a connecting sleeve, mounted around the main shaft and positioned between the top end and the operating sleeve;

a compression spring, mounted around the main shaft, with two ends thereof contacting the connecting sleeve and the operating sleeve, respectively;

a first canopy, with a central portion thereof fixed to the operating sleeve;

a second canopy, with a central portion thereof fixed to the top end;

a skeleton, connected with the top end and the connecting sleeve, and disposed between the first canopy and the second canopy; and a pull-moving mechanism, slidingly disposed on the skeleton and having a sliding unit and a connecting unit, two ends of the connecting unit pivotally disposed on the sliding unit and the operating sleeve, respectively;

wherein when the operating sleeve is at the folding position, the skeleton folds toward the top end, so as to fold up the first canopy and the second canopy, and the sliding unit slides toward the main shaft, such that the position of the connecting unit pivotally disposed on the skeleton moves toward the main shaft.

With such configuration, the operating sleeve is connected with the sliding unit which is slidingly disposed on the skeleton through the connecting unit, such that when the operating sleeve slides from the opening position to the folding position, the sliding unit is driven to slide toward the main shaft. As a result, the position of the connecting unit pivotally disposed on the skeleton relatively moves to the main shaft, whereby the skeleton completely adheres to the main shaft when folding up toward the top end of the main shaft, so as to decrease the general volume of the folded umbrella and prevent the skeleton from being broken due to incomplete folding.

DETAILED DESCRIPTION OF THE INVENTION

Figure 1:
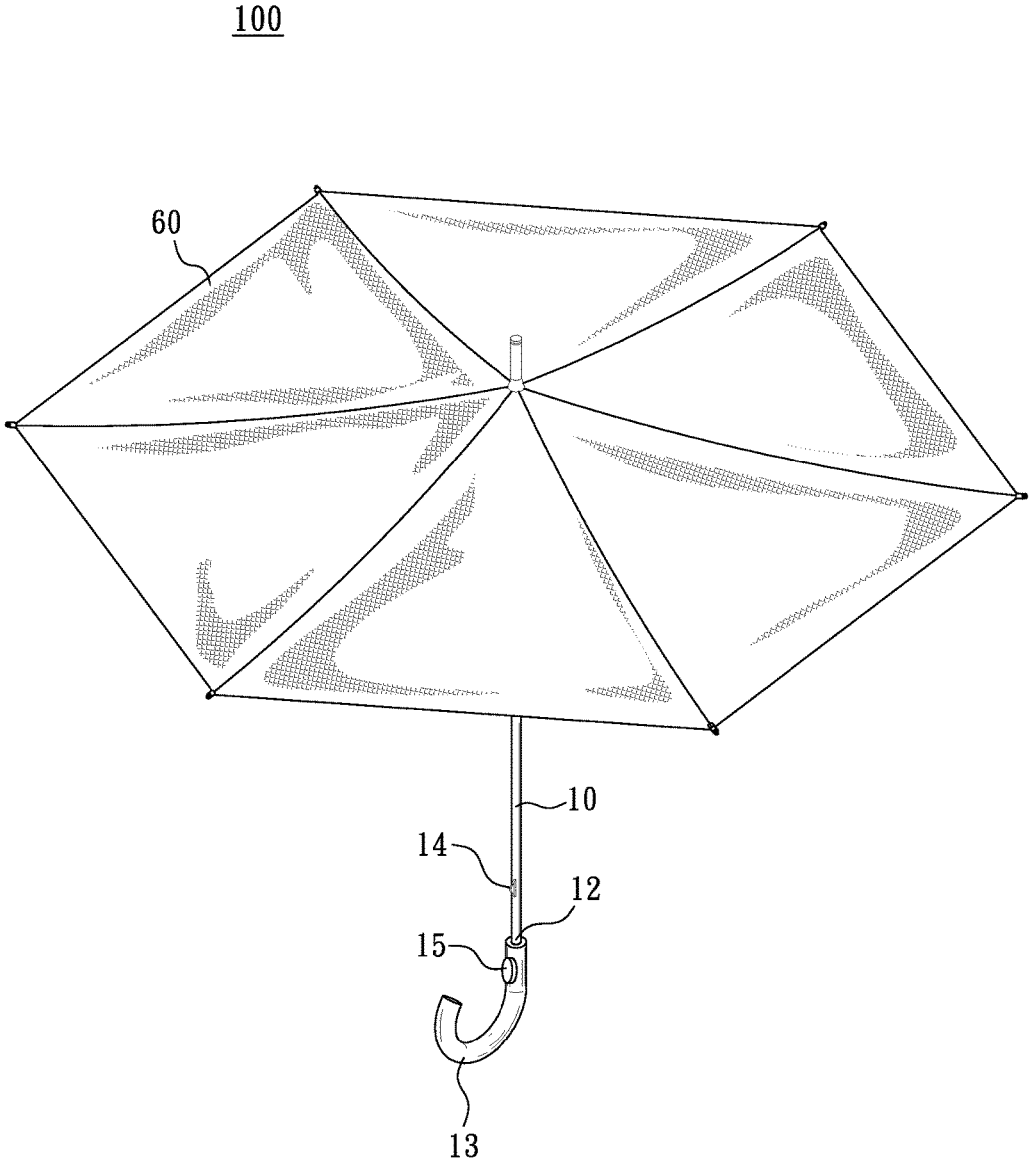
FIG. 1 is a perspective view of the inversely foldable automatic umbrella in accordance with the present invention, illustrating the operating sleeve at the opening position.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 7, an inversely foldable automatic umbrella 100 is provided, comprising a main shaft 10, an operating sleeve 20, a connecting sleeve 30, a compression spring 40, a first canopy 50, a second canopy 60, a skeleton 70, and a pull-moving mechanism 80.

The main shaft 10 has a top end 11, a bottom end 12, and a handle 13 installed on the bottom end 12.

The operating sleeve 20 is mounted around the main shaft 10 and allowed to move between a folding position adjacent to the bottom end 12 of the main shaft 10 and an opening position adjacent to the top end 11 of the main shaft 10. The operating sleeve 20 has a connecting end 21 disposed toward the top end 11 of the main shaft 10 and a gripping end 22 disposed toward the bottom end 12 of the main shaft 10. In addition, a fixer 14 and a switch 15 are disposed on the main shaft 10 adjacent to the bottom end 12. When the operating sleeve 20 is at the folding position, the switch 15 is used to control the fixer 14 which is engaged with the inner edge of the operating sleeve 20, such that the operating sleeve 20 is optionally positioned at the folding position.

The connecting sleeve 30 is mounted around the main shaft 10 and disposed between the top end 11 of the main shaft 10 and the operating sleeve 20. The outer diameter of the connecting sleeve 30 is smaller than the inner diameter of the operating sleeve 20. Also, the connecting sleeve 30 has a blocking edge 31 which is disposed toward the top end 11 and provided with an outer diameter larger than the outer diameter of the connecting sleeve 30.

Figure 5:
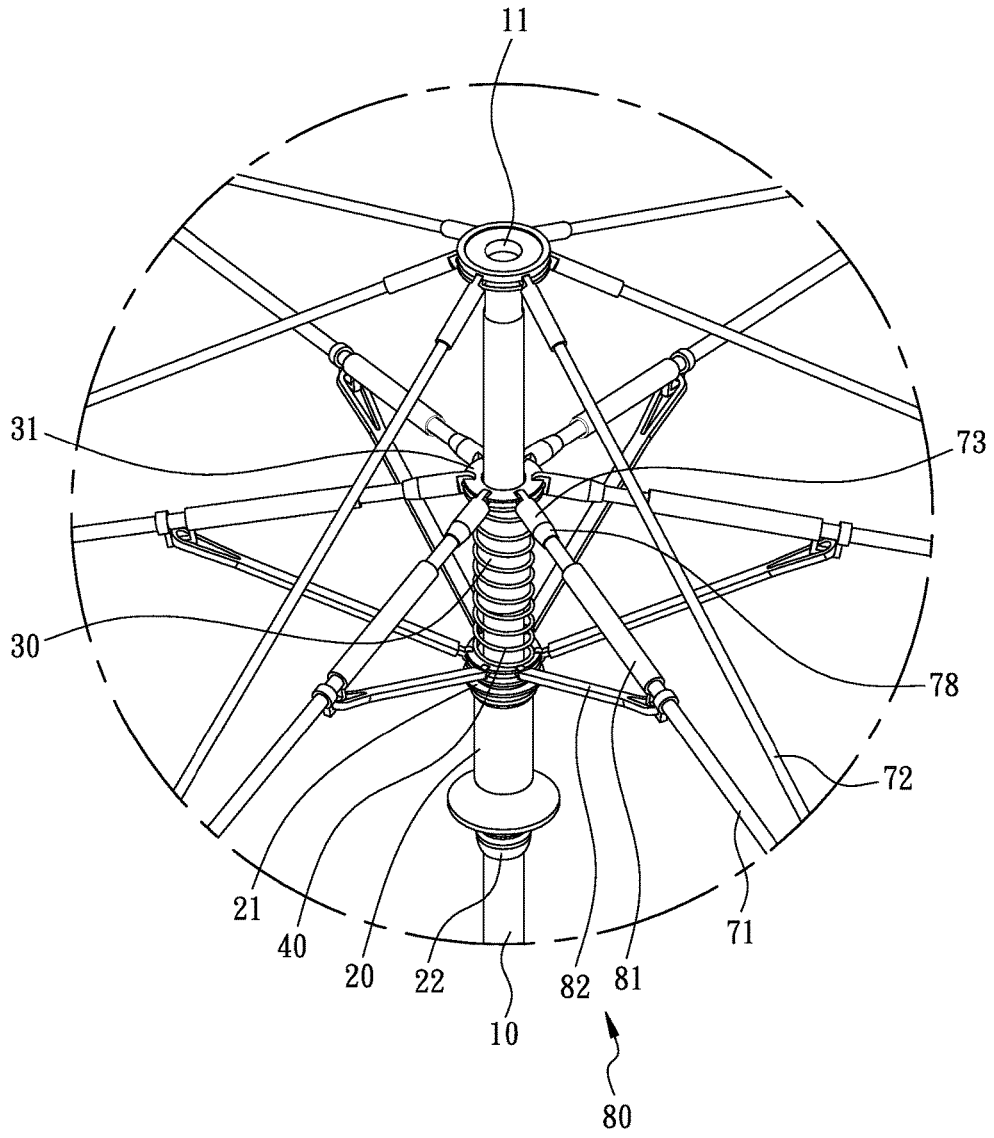
FIG. 5 is a partially enlarged view of FIG. 4.

The compression spring 40 is mounted around the connecting sleeve 30, and the free length of the compression spring 40 is larger than the length of the connecting sleeve 30. Two ends of the compression spring 40 contact the blocking edge 31 of the connecting sleeve 30 and the connecting end 21 of the operating sleeve 20, respectively, as shown in FIG. 5.

Figure 2:
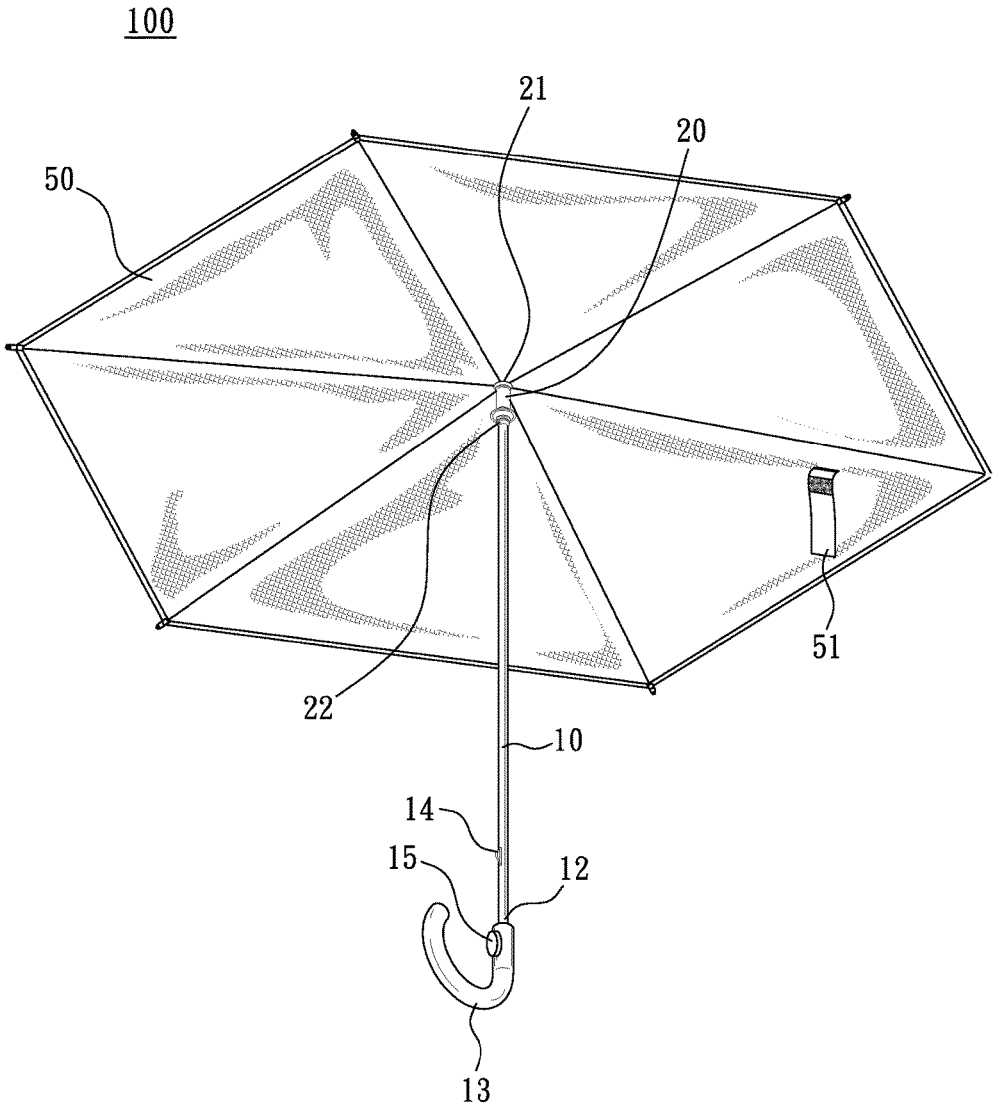
FIG. 2 is another perspective view of FIG. 1 from a different view point.
Figure 3:
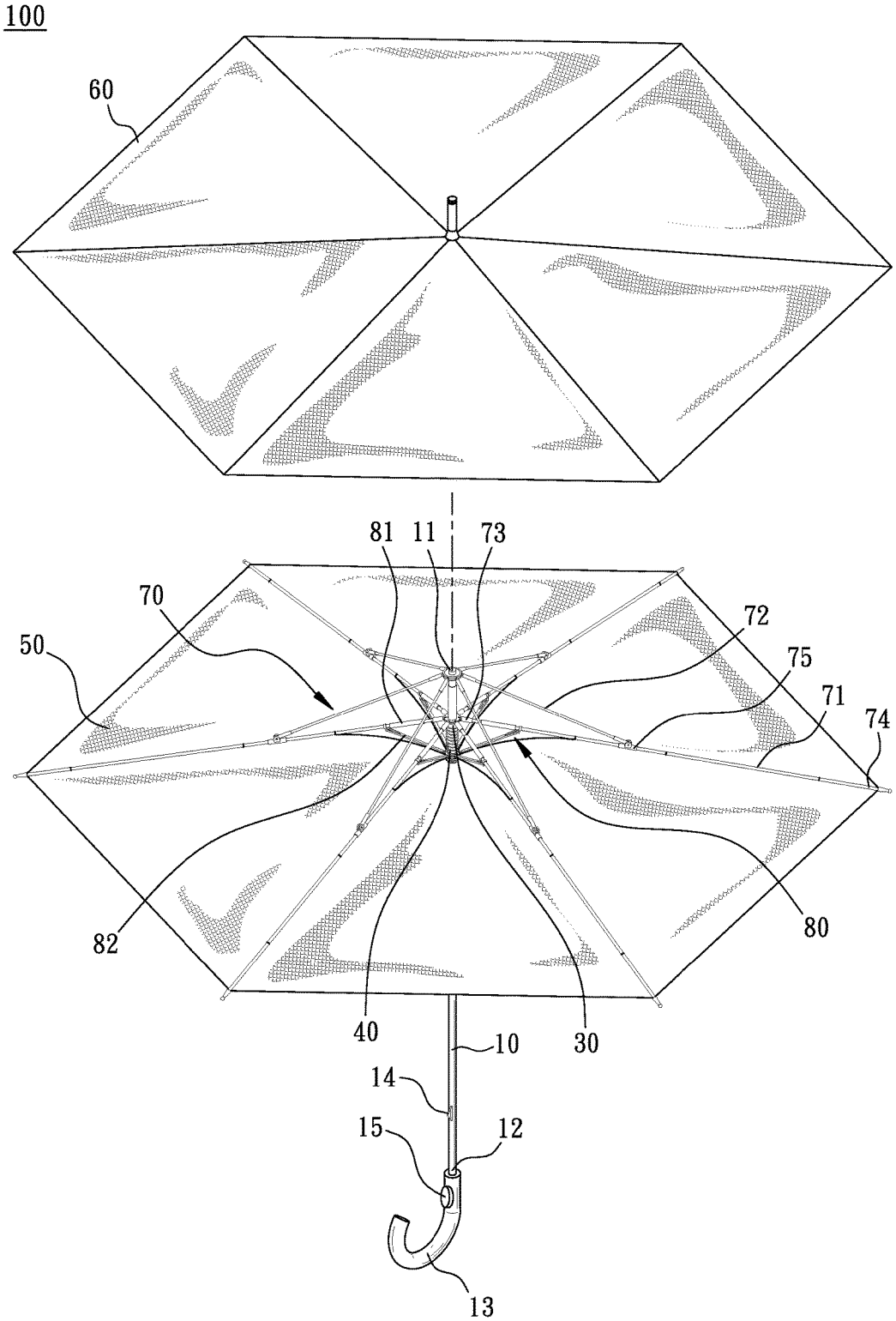
FIG. 3 is a perspective view of the inversely foldable automatic umbrella with the second canopy detached from the main shaft.
Figure 4:
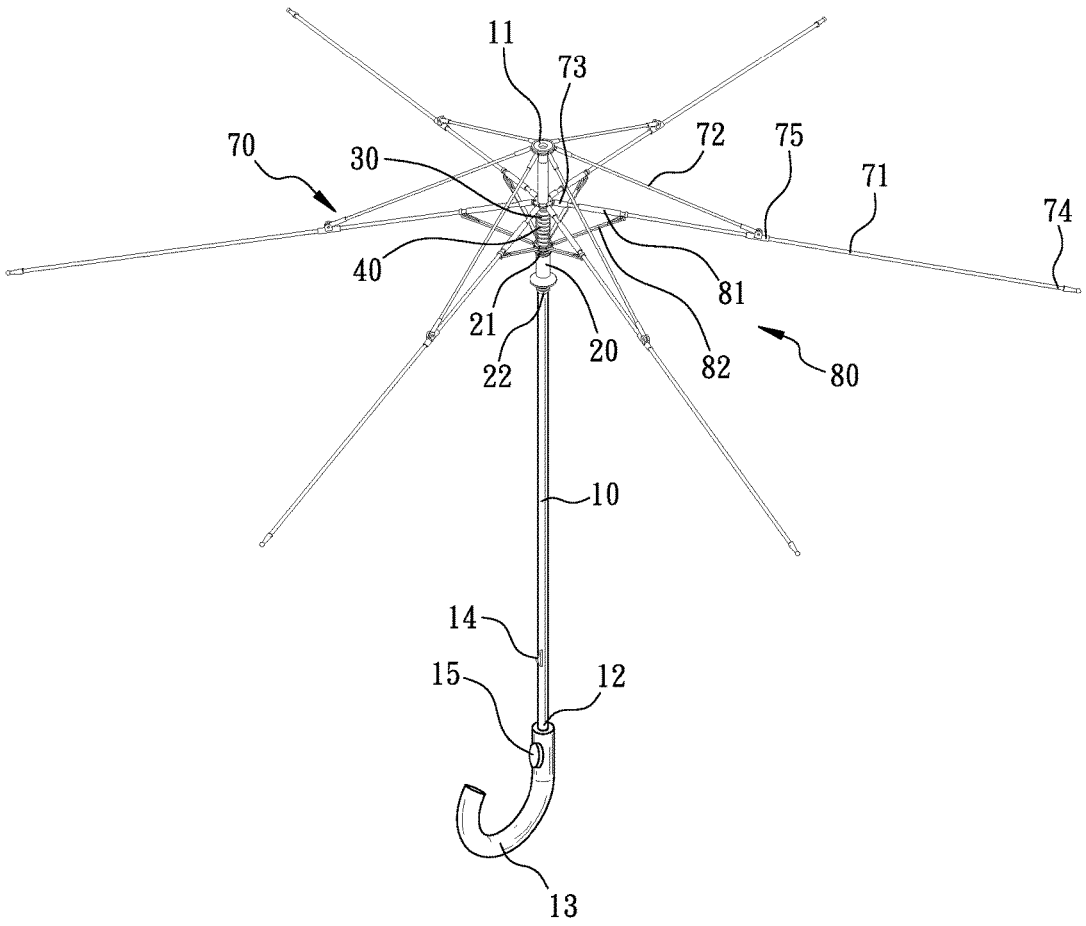
FIG. 4 is a perspective view of the inversely foldable automatic umbrella with the second canopy and the first canopy detached from the main shaft.

The first canopy 50 has a central portion thereof fixed to the connecting end 21 of the operating sleeve 20. A binding band 51 is disposed on one side of the first canopy 50 toward the bottom end 12 of the main shaft 10, as shown in FIG. 2.

The second canopy 60 has a central portion thereof fixed to the top end 11 of the main shaft 10.

The skeleton 70 is connected with the top end 11 and the connecting sleeve 30 and disposed between the first canopy 50 and the second canopy 60. In the preferred embodiment, the skeleton 70 has plural bones which are arranged in a ring shape and mounted between the first canopy 50 and the second canopy 60. Also, each bone is provided with a first foldable rod 71 and a second foldable rod 72.

Figure 6:
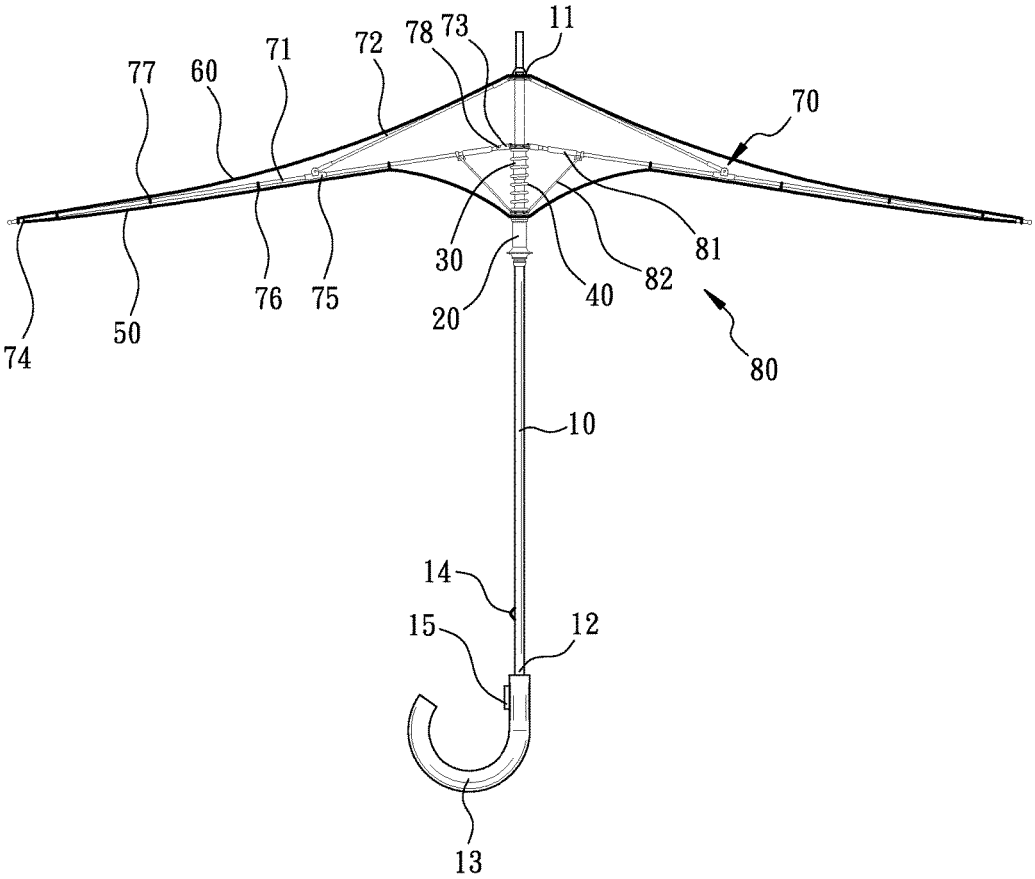
FIG. 6 is a schematic view illustrating the operating sleeve at the opening position.

Each first foldable rod 71 has a disposition end 73, a fixing end 74, and a pivotal part 75 disposed between the disposition end 73 and the fixing end 74. Each disposition end 73 is pivotally disposed on the blocking edge 31 of the connecting sleeve 30, as shown in FIG. 5. Each fixing end 74 is connected with an edge of the first canopy 50 and an edge of the second canopy 60, as shown in FIG. 6; preferably, the connection is carried out in a manner of sewing. The distance from each pivotal part 75 to the corresponding disposition end 73 is slightly smaller than the distance from each pivotal part 75 to the corresponding fixing end 74. One end of each second foldable rod 72 is pivotally disposed on the top end 11 of the main shaft 10, with the other end of each second foldable rod 72 pivotally disposed on the corresponding pivotal part 75.

Also, each first foldable rod 71 has at least one first connecting part 76 and at least one second connecting part 77, which are disposed between each corresponding disposition end 73 and fixing end 74, so as to connect the first canopy 50 and the second canopy 60, respectively; preferably, the connection above is carried out in a manner of sewing.

The pull-moving mechanism 80 has a sliding unit and a connecting unit. The sliding unit has plural sliding barrels 81, and each first foldable rod 71 has a sliding barrel 81 slidingly disposed thereon between the pivotal part 75 and the disposition end 73. The connecting unit has plural connecting rods 82 corresponding to the sliding barrels 81. Two ends of each connecting rod 82 are pivotally disposed on the corresponding sliding barrel 81 and the connecting end 21 of the operating sleeve 20, respectively, such that each connecting rod 82 is pivotally disposed on one end of the sliding barrel 81 facing the corresponding fixing end 74.

Figure 7:
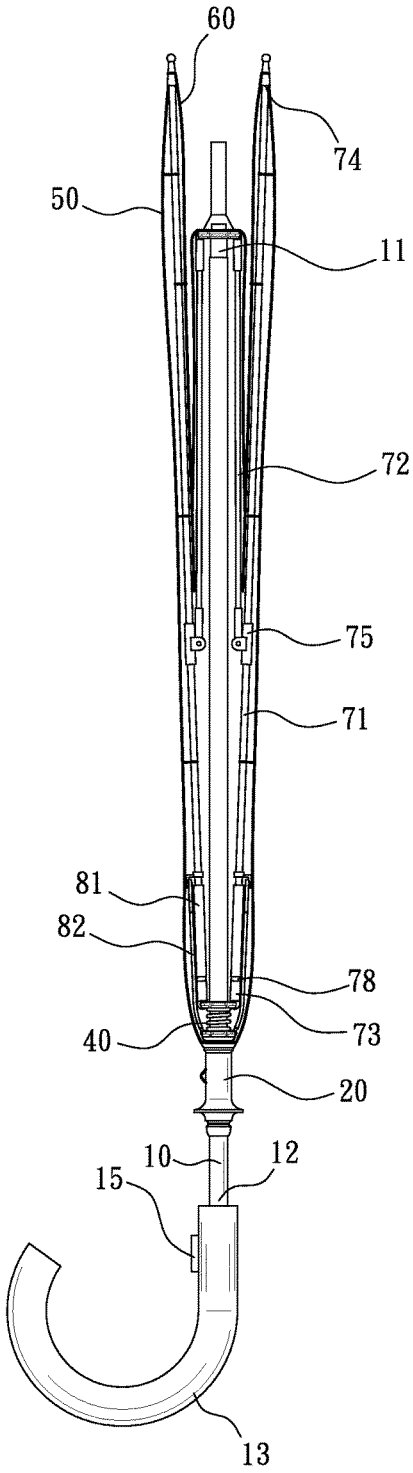
FIG. 7 is a schematic view illustrating the operating sleeve at the folding position.

Further, the disposition end 73 of each first foldable rod 71 has a blocking portion 78. The blocking portion 78 tapers toward the corresponding fixing end 74. When the operating sleeve 20 is at the folding position, each sliding barrel 81 slides toward the corresponding disposition end 73 and be mounted around the blocking portion 78, as shown in FIG. 7. When the operating sleeve 20 is at the opening position, each sliding barrel 81 slides toward the corresponding fixing end 74 and be detached from the blocking portion 78, as shown in FIG. 6.

With the foregoing configuration, operation of the present invention will be illustrated below.

When the inversely foldable automatic umbrella 100 is to be folded up, the operating sleeve 20 is manually slid from the opening position to the folding position. Thereby, the first foldable rods 71 and the second foldable rods 72 are triggered to move, forcing the skeleton 70 to be folded toward the top end 11 of the main shaft 10, whereby the first canopy 50 and the second canopy 60 are folded up, as shown in FIG. 7. Each sliding barrel 81 is driven by the corresponding connecting rod 82 and the operating sleeve 20, so as to slide toward the disposition end 73 of the corresponding first foldable rod 71 and be mounted around the blocking portion 78.

Meanwhile, the compression spring 40 is compressed due to the pushing of the connecting sleeve 30 and the operating sleeve 20, and the operating sleeve 20 is fixed at the folding position by the fixer 14.

When the inversely foldable automatic umbrella 100 is to be opened, the switch 15 is pressed, such that the fixer 14 releases the operating sleeve 20. Subsequently, the compression spring 40, by use of the resilient force thereof, pushes the connecting sleeve 30 to trigger the operating sleeve 20 to slide from the folding position to the opening position. Also, each first foldable rod 71 and second foldable rod 72 are driven to move, such that the skeleton 70 expands toward the bottom end 12 of the main shaft 10, whereby the first canopy 50 and the second canopy 60 expand, as shown in FIG. 1 and FIG. 6. Each sliding barrel 81 slides toward the corresponding fixing end 74 and is detached from the blocking portion 78.

To sum up, the operating sleeve 20 is connected with the sliding barrel 81 on each first foldable rod 71 through each corresponding connecting rod 82. When the operating sleeve 20 slides from the opening position to the folding position, each sliding barrel 81 slides toward the disposition end 73 of the corresponding first foldable rod 71, such that the position of each connecting rod 82 pivotally disposed on each corresponding first foldable rod 71 moves toward the main shaft 10, whereby the skeleton 70 completely adheres to the main shaft 10 when being folded toward the top end 11 of the main shaft 10, thus decreasing the general volume of the inversely foldable automatic umbrella 100 and preventing the skeleton 70 from broken due to incomplete folding.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An inversely foldable automatic umbrella, comprising:

a main shaft, having a top end and a bottom end;

an operating sleeve, mounted around the main shaft, moving between a folding position and an opening position, and optionally positioned at the folding position;

a connecting sleeve, mounted around the main shaft and positioned between the top end and the operating sleeve;

a compression spring, mounted around the main shaft with two ends of the compression spring contacting the connecting sleeve and the operating sleeve, respectively;

a first canopy with a central portion thereof fixed to the operating sleeve;

a second canopy with a central portion thereof fixed to the top end;

a skeleton, connected with the top end and the connecting sleeve, and disposed between the first canopy and the second canopy, the skeleton having plural bones arranged in a ring shape and mounted between the first canopy and the second canopy, each bone having a first foldable rod and a second foldable rod, one end of each first foldable rod pivotally disposed on the connecting sleeve and the other end of the first foldable rod connected with an edge of the first canopy and an edge of the second canopy, one end of the second foldable rod pivotally disposed on the top end and the other end of the second foldable rod pivotally disposed on a middle section of the first foldable rod; and a pull-moving mechanism, slidingly disposed on the skeleton and having a sliding unit and a connecting unit, two ends of the connecting unit pivotally disposed on the sliding unit and the operating sleeve, respectively, the sliding unit having plural sliding barrels, each sliding barrel slidingly disposed on each corresponding first foldable rod, the connecting unit having plural connecting rods corresponding to the sliding barrels, two ends of each connecting rod pivotally disposed on the corresponding sliding barrel and the operating sleeve;

wherein each first foldable rod has a disposition end, a fixing end, and a pivotal part disposed between the disposition end and the fixing end, each disposition end pivotally disposed on the connecting sleeve and having a blocking portion tapering toward the corresponding fixing end, each fixing end connected to the edge of the first canopy and the edge of the second canopy, the second foldable rod pivotally disposed on the corresponding pivotal part, each sliding barrel slidingly disposed between the corresponding pivotal part and the disposition end;

wherein when the operating sleeve is at the folding position, each sliding barrel is mounted around the blocking portion, and the skeleton folds toward the top end, so as to fold up the first canopy and the second canopy, and the sliding unit slides toward the main shaft, such that the position of the connecting unit pivotally disposed on the skeleton moves toward the main shaft; when the operating sleeve is at the opening position, the sliding barrels is detached from the corresponding blocking portion.

2. The automatic umbrella of claim 1, wherein each connecting rod is pivotally disposed on one end of the corresponding sliding barrel facing the fixing end.

3. The automatic umbrella of claim 1, wherein the distance from each pivotal part to the corresponding disposition end is smaller than the distance from each pivotal part to the corresponding fixing end.

4. The automatic umbrella of claim 1, wherein each first foldable rod has at least one first connecting part and at least one second connecting part disposed between each corresponding disposition end and fixing end for connecting the first canopy and the second canopy, respectively.

5. The automatic umbrella of claim 1, wherein the connecting sleeve has a blocking edge which is provided with an outer diameter larger than the outer diameter of the connecting sleeve, the skeleton is pivotally disposed on the blocking edge, and the two ends of the compression spring contact the blocking edge and the operating sleeve, respectively.

6. The automatic umbrella of claim 5, wherein the free length of compression spring is larger than the length of the connecting sleeve.

7. The automatic umbrella of claim 5, wherein the outer diameter of the connecting sleeve is smaller than the inner diameter of the operating sleeve.

8. The automatic umbrella of claim 1, wherein a fixer and a switch are disposed on the main shaft adjacent to the bottom end; when the operating sleeve is at the folding position, the switch is used to control the fixer to be engaged with the inner edge of the operating sleeve.

* * * * *